United States Patent [19]

Kimura et al.

[11] 4,257,531

[45] Mar. 24, 1981

[54] DELIVERY APPARATUS FOR AUTOMATIC NEWSPAPER VENDING MACHINE

[75] Inventors: Yoshiaki Kimura, Osaka; Terutada Nakazawa, Tenri, both of Japan

[73] Assignee: Kinki Sharyo Kabushiki Kaisha, Japan

[21] Appl. No.: 25,590

[22] Filed: Mar. 30, 1979

[30] Foreign Application Priority Data

Mar. 1, 1979 [JP] Japan ..... 54/26397

[51] Int. Cl.[3] ..... B65H 1/02

[52] U.S. Cl. ..... 221/227; 221/129

[58] Field of Search ..... 221/129, 126, 130, 253, 221/227, 232, 226, 230, 90, 225, 231, 295, 125; 271/8 A, 150

[56] References Cited

U.S. PATENT DOCUMENTS

| | | | |
|---|---|---|---|
| 3,001,669 | 9/1961 | Tandler et al. | 221/129 X |
| 3,062,407 | 11/1962 | Cordis | 221/230 X |
| 3,425,596 | 2/1969 | Marczak et al. | 221/227 X |
| 3,598,400 | 8/1971 | Nelson | 271/150 |

*Primary Examiner*—Stanley H. Tollberg
*Attorney, Agent, or Firm*—Holman & Stern

[57] ABSTRACT

An apparatus comprises a support plate slanting downward to the rear and attached to a frame, a pair of belts arranged on opposite sides of the support plate along the slant thereof for supporting stacked newspapers thereon together with the support plate, a pushing plate attached to the belts and extending upright from the upper surfaces of the belts, and a drive unit for driving the belts and the pushing plate at a low speed in the direction of delivery of the newspapers. A pile of doubled newspapers placed in an upright position on the support plate and belts with the folds down is supported on the rear side by the pushing plate. The belts, when driven, drop the newspapers one by one off the support plate into an outlet.

5 Claims, 5 Drawing Figures

DELIVERY APPARATUS FOR AUTOMATIC NEWSPAPER VENDING MACHINE

BRIEF SUMMARY OF THE INVENTION

This invention relates to an automatic newspaper vending machine, and more particularly to a delivery apparatus for a coin-operated automatic vending machine by which newspapers are delivered from the machine one by one.

Various self-service vending machines have been proposed for newspapers, weekly newspapers, etc. Japanese Pat. No. 539439 (Patent Publication No. 22068/1968) discloses a newspaper vending machine which delivers a newspaper every time a manual level is operated after dropping a coin into the machine. With the vending machine disclosed in Registered Japanese Utility Model No. 1256132 (Utility Model Publication No. 8553/1978), newspapers are delivered one at a time upon dropping a coin into the machine. These machines are so adapted that the newspapers stacked in a horizontal position on a support table or shelf within the machine are delivered one at a time from the uppermost position every time a coin is dropped in.

When newspapers are piled on a shelf, it is very difficult to view the headline of the newspaper even if the automatic vending machine has a transparent front panel as of glass. Especially when many kinds of newspapers are made available by one automatic vending machine, it is almost impossible to view the headlines of the newspapers placed on lower shelves, whereas with newspaper vending machines it is important that the headlines be visible with ease.

The newspapers stacked in a planar horizontal position on the shelf are delivered one by one by a pawl which is placed on the uppermost paper in pressing contact therewith and which is driven in the direction of delivery in engagement with the upper surface of the paper. However there is an unnegligible frictional force acting between the uppermost newspaper and the immediately underlying newspaper which is in contact with the uppermost copy over a wide area. Moreover the pressure for holding the pawl in engagement with the newspaper adds to the frictional force, with the result that when delivering the uppermost newspaper in sliding contact with the underlying newspaper, the pawl is liable to disturb the stack of newspapers or break the paper which the pawl engages. Additionally since the frictional force varies greatly with the quality of the newsprint, the humidity of air, etc., it is extremely difficult to set or adjust the pawl engaging pressure.

An object of this invention is to provide a delivery apparatus adapted for use in an automatic newspaper vending machine which accomodates many kinds of newspapers on different shelves as assorted in accordance with the kind so as to make the newspapers available by self-service.

Another object of this invention is to provide a delivery apparatus for an automatic vending machine by which the newspapers placed on each shelf can be delivered reliably one at a time upon dropping in a coin without using the pawl heretofore used.

Still another object of this invention is to provide an apparatus by which newspapers can be delivered to an outlet almost instantaneously on dropping in a coin notwithstanding that the newspapers issued on a particular day may differ in thickness from those issued on another day.

According to this invention, the automatic vending machine has a front panel which can be made from transparent glass or transparent synthetic resin such as acrylic resin so that the headlines of the newspapers placed on the shelves within the machine can be seen through the front panel. Whereas newspapers are usually placed on the shelf as stacked in a planar horizontal position, the apparatus of this invention is characterized in that newspapers are placed thereon in an upright but rearwardly inclined position at a level progressively lowering toward the rear of the apparatus, as leaned on a shelf member so that the headline can be seen from the front.

The newspapers to be sold usually are each folded in two, and a suitable number of copies are delivered to the dealers as stacked in this state.

Stated more specifically this invention provides an apparatus comprising a support plate for supporting a pile of doubled newspapers thereon in an upright position with the folds down, a pair of belts arranged on opposite sides of the support plate for supporting the pile at its bottom along with the support plate, a pushing plate attached to the belts and extending upright therefrom for supporting the pile as leaned thereon, and means for driving the belts and the pushing plate at a low speed in the direction of delivery of the newspapers. The combined width of the support plate and the opposite belts is not larger than the width of the newspapers. The assembly of the support plate, belts and pushing plate is attached to the frame of an automatic vending machine in a position slanting downward toward the rear of the machine.

Since the assembly of the support plate, belts and pushing plate is thus slanted, the stacked newspapers can be supported on the apparatus while leaning on the pushing plate and will not be bent at the midportion and fall. In this position, at least the upper half of the first page of the newspaper faces the front of the vending machine, permitting the customer to easily read the headlines through the front panel when the panel is made from transparent material. The front panel nevertheless need not be so made when it is not necessary to render the newspaper headlines visible from outside.

The apparatus of this invention further includes a retaining plate for temporarily retaining the newspaper pushed out from and falling off the front end of the support plate, such that when the customer depresses a push button, the newspaper immediately falls off the retaining plate into the outlet of the vending machine. Accordingly the time taken for the belts to deliver the newspaper onto the retaining plate is not included in the waiting time needed for the sale of the newspaper. This makes it possible to shorten the sale time without the necessity of driving the belts at a higher speed.

These and other features of this invention will become more apparent from the following description given with reference to the accompanying drawings.

DETAILED DESCRIPTION

This invention will be described below with reference to the illustrated embodiment.

Figure 1:
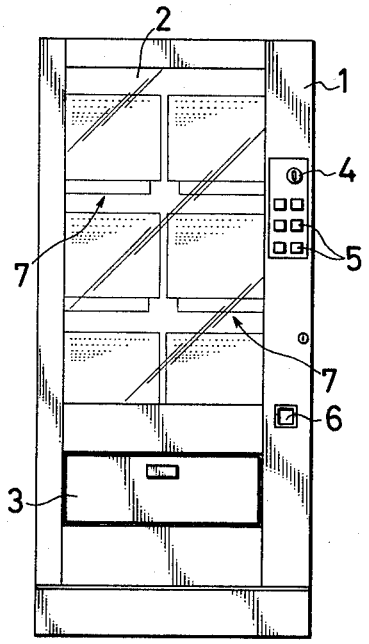
FIG. 1 is a front elevational view showing the entire construction of an automatic newspaper vending machine embodying the present invention.
Figure 2:
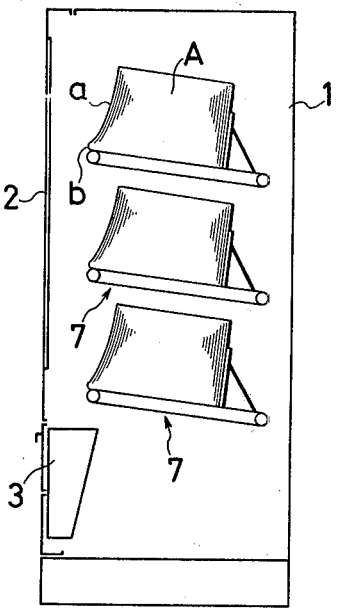
FIG. 2 is a side elevation showing the arrangement of the shelves of the vending machine.

FIGS. 1 and 2 show the body 1 of an automatic newspaper vending machine in the form of a box having a front panel 2 made from transparent glass or plastics. The body 1 has a newspaper outlet 3 in the form of a drawer at a front lower portion and is formed at a front side portion with a coin slot 4, push buttons 5 for selecting the newspaper to be purchased, and a coin return outlet 6. The body 1 is equipped in its interior with shelves 7 identical in number with the push buttons 5 and each adapted to place thereon a pile A of newspapers. The front panel 2, for example, is openable to place newspapers on the shelves 7. Each shelf 7 serves to accommodate newspapers and also to deliver them one by one to the newspaper outlet 3.

Figure 3:
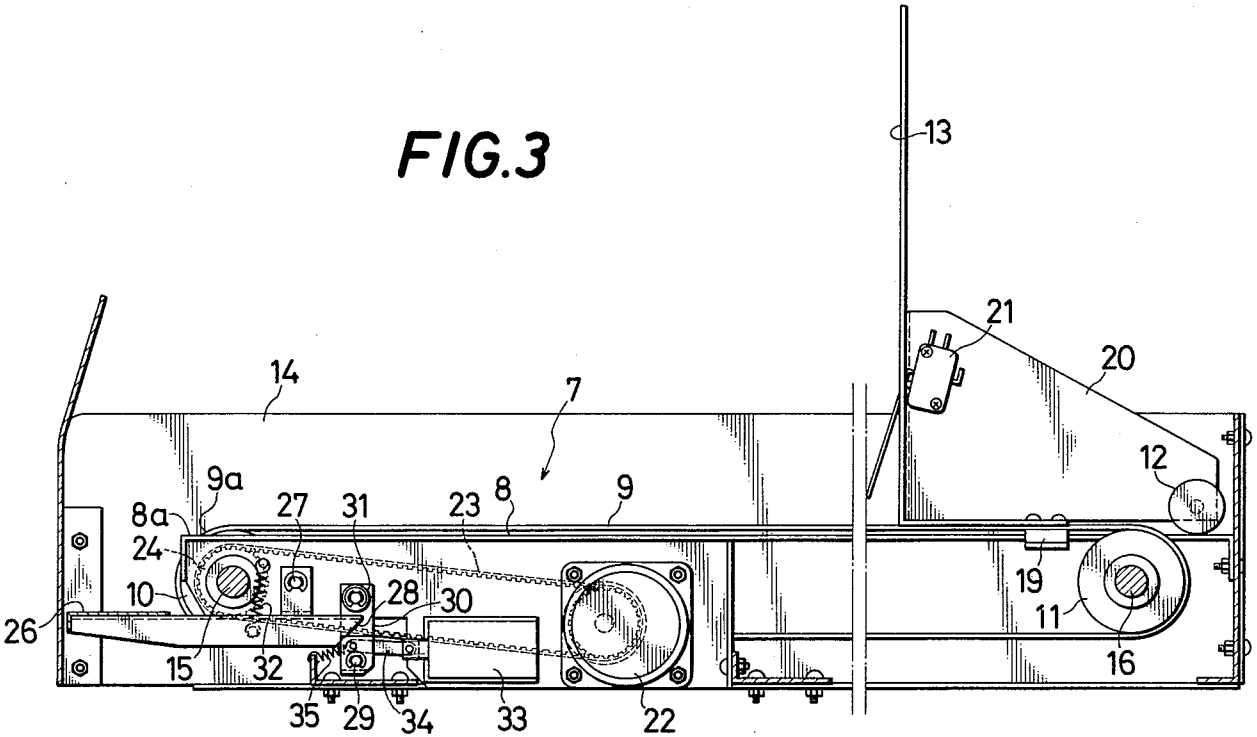
FIG. 3 is a side elevation showing a delivery apparatus serving as the shelf and specifically embodying the invention.
Figure 4:
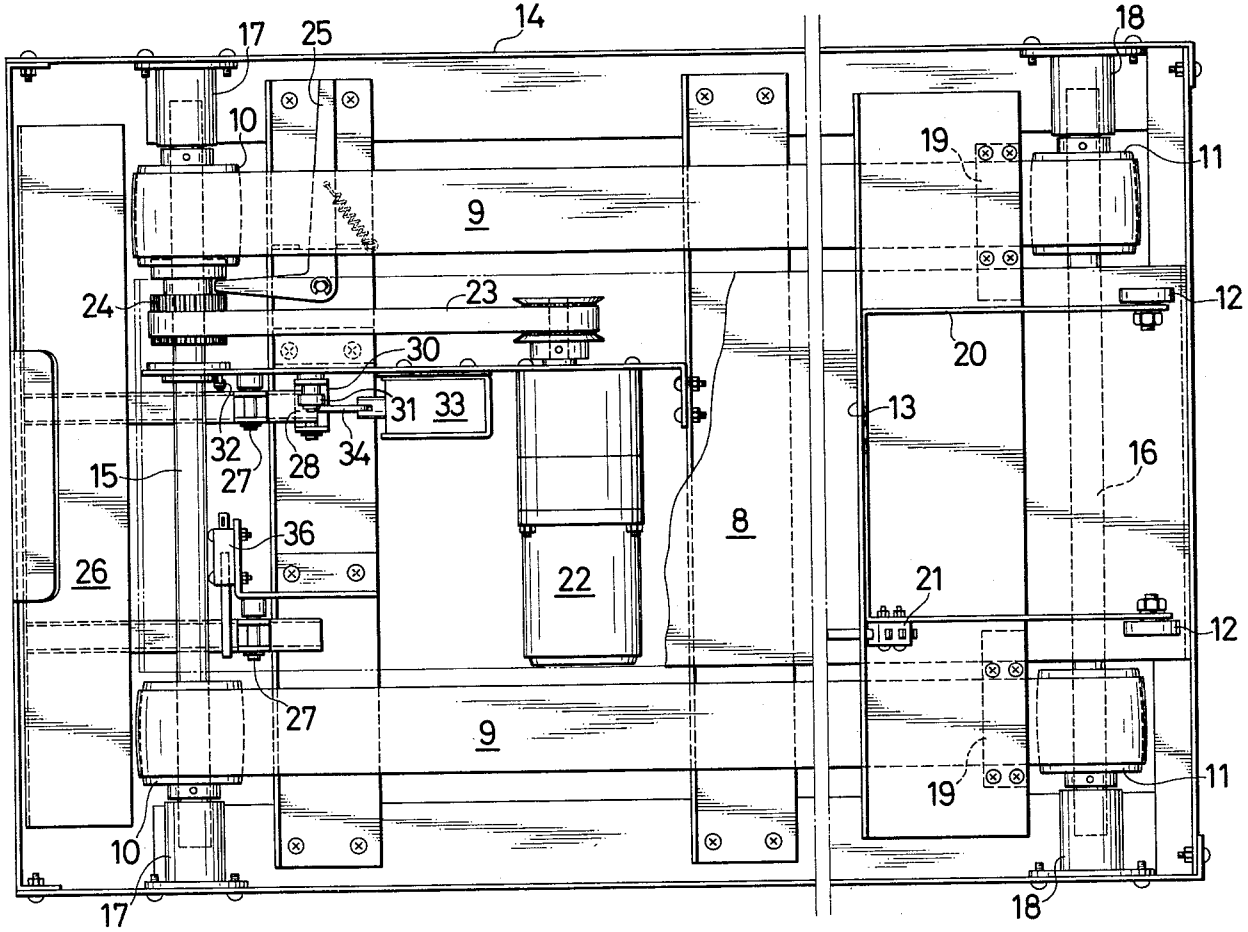
FIG. 4 is a plan view showing the embodiment of FIG. 3.

As shown in greater detail in FIGS. 3 and 4, the delivery apparatus 7 is an assembly comprising a support plate 8 having a smooth upper surface, a pair of belts 9 arranged on opposite sides of the support plate 8, drive pulleys 10 and tension pulleys 11 for the belts 9, and a pushing plate 13 attached to the belts 9, movably supported on the support plate 8 by rollers 12 and projecting substantially upright from the belts 9. The combined width of the support plate 8 and opposite side belts 9 is not larger than the width of the newspapers to be placed on the plate and belts. The assembly of the support plate 8, belts 9 and pushing plate 13 is attached to the body 1 of the vending machine in a position slanting downward toward the rear of the machine. A support frame 14 for the assembly is fixedly provided with the support plate 8. A shaft 15 for the drive pulleys 10 and a shaft 16 for the tension pulleys 11 are supported by bearings 17 and 18 on the support frame 14. The pushing plate 13 is connected to the belts 9 by fastening members 19. The support frame 14 is attached to the body 1 in a suitably rearwardly inclined position. A member 20 supports the pushing plate 13 from behind. The pile A of newspapers, when placed on the support plate 8 and on the belts 9 and leaned on the pushing plate 13, is detected by a microswitch 21, which while in an ON state permits the operation of the belts 9 on depression of a push button 5. A motor 22 for driving the belts 9 at a low speed is mounted on the support frame 14 to rotate the drive pulleys 10 by way of a timing belt 23 and a clutch 24. After the newspapers on the apparatus 7 have all been delivered, a lever 25 is operated to disengage the clutch 24, and the pushing plate 13 is pushed rearward to reversely turn the belts 9, thus rendering the apparatus 7 loadable with another pile A of newspapers again.

The pile A of doubled newspapers is placed on the support plate 8 and on the belts 9 with the folds b down, as leaned on the pushing plate 13. When the belts 9 are then driven at a low speed by the motor 22, the pushing plate 13 slowly pushes the pile A forward, namely toward the front panel 2, in sliding contact with the support plate 8, causing newspapers to fall off the front end of the support plate 8 into the outlet 3. The belts 9, when carrying the pile of newspapers, A, thereon, are bent under gravity, with the result that the newspapers will be supported substantially by the support plate 8. Accordingly the pulleys 10 and 11 are so positioned that the upper surfaces of the belts 9, when unloaded, will be at a slightly higher level than the support plate 8 to offset the bending. However if the pulleys 10 are thus positioned, the foremost newspaper a to be forced out by the belts 9 and the pushing plate 13 falls upon passing over the pulleys 10, with the likelihood that the next newspaper a' will also fall simultaneously with the newspaper a owing to the friction therebetween, even when the belts 9 are stopped upon the fall of the foremost newspaper a.

Figure 5:
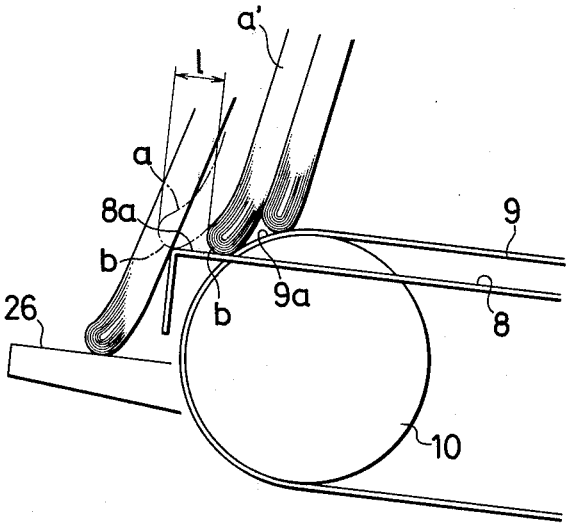
FIG. 5 is a fragmentary side elevation on an enlarged scale for illustrating the operation of the apparatus.

To eliminate this drawback, the front end 8*a* of the support plate 8 is made to project forward by a suitable length beyond the bent portions 9*a* of the belts 9 around the pulleys 10. Since the newspaper is folded in two, the fold b has a slightly larger thickness than the other portion of the newspaper, so that the pile A on the support plate 8 and belts 9 is shaped to project forward at the fold side as seen in FIG. 2. Thus if the front end 8*a* of the support plate 8 is made to project slightly forward beyond the curved portions 9*a* of the belts 9, the newspaper a passing over the pulley 10 temporarily rests on the front end 8*a* at its fold b, is then pushed forward over the length of projection, l, as seen in FIG. 5 and falls off the support plate 8 into the outlet 3. As a result, the front end 8*a* of the support plate 8 projecting forward by the length l beyond the belt curved portions 9*a* serves to properly separate the foremost newspaper a from the subsequent newspaper a' without allowing two copies to fall at the same time. Additionally the portions of the pulleys 10 projecting above the support plate 8 act to vertically displace newspapers at the front end of the pile A, thus facilitating the separation of individual newspapers. As already stated, the newspaper has a slightly larger thickness at the fold portion b than at the other portion, the front end of the pile A projects forward at the fold side, and the upward projections of the pulleys 10 vertically displace the newspapers at the front end of the pile A. Because of these features, the foremost newspaper a and the next newspaper a', upon sliding down the pulley portions, are spaced apart at the fold side b by a distance which is larger than the thickness of the newspaper. In this regard, the length of projection, l, may be made approximate to the spacing.

When the motor 22 is stopped upon the detection of the fall of the newspaper, one newspaper alone can be delivered to the outlet 3 properly. Since the pile A of newspapers is placed on the support plate 8 and belts 9 are leaned on the pushing plate 13, two newspapers will not fall at the same time owing to the friction acting between the two papers, while the newspapers can be fed out separately without being affected by variations in such frictional force due to changes in the atmospheric moisture. Additionally the newspapers can be handled free of any scratches, damage or break since no engaging pawl is used for delivery.

In order to shorten the sale time without driving the belts at a higher speed than necessary, in other words, without permitting troubles to develop when the motor is brought to a halt or when the newspaper is pushed out with an inertial force, there is provided a retaining plate 26 positioned immediately below the support plate 8 and projecting into the path of fall of the newspaper. The retaining plate 26 has a base portion pivoted by pins 27 to a suitable portion of the support frame 14 and a rear end portion 28 engageable with the bottom of a roller 31 on an arm 30 pivoted to the frame 14 by a pin 29. The retaining plate 26 is urged into the path by a weak spring 32. A solenoid 33 mounted on the support frame 14 is energized on depression of a push button 5 after dropping in a coin. The solenoid 33 is connected by a link 34 to the arm 30, which is always biased by a spring 35 to an upright position. A microswitch 36 has a sensor in engagement with the retaining plate 26 for detecting a newspaper placed onto the retaining plate 26.

When the foremost newspaper a is pushed out from the front end 8*a* of the support plate 8 and falls onto the retaining plate 26, the retaining plate 26 slightly turns about the pins 27 and is held engaged at its rear end portion 28 with the roller 31 on the arm 30 (see FIG. 5). The spring 32 for biasing the retaining plate 26 has such characteristics as to permit the plate 26 to turn in this way under the gravity acting on one newspaper. On detecting the movement of the retaining plate 26, the microswitch 36 deenergizes the motor 22 to bring the belts 9 to a halt.

A coin is dropped in and the push button 5 concerned is depressed in this state, whereupon the solenoid 33 is energized, turning the arm 30 clockwise in FIG. 3 to release the retaining plate 26. The plate 26 therefore turns counterclockwise away from the path of fall of the newspaper under the gravity acting on the paper, allowing the newspaper to fall into the outlet 3. On releasing the plate 26, the solenoid 33 is deenergized, while the retaining plate 26 is turned clockwise by the spring 32 immediately after the fall of the newspaper. At this time, the rear end portion 28 temporarily forces the roller 31 away therefrom and then stops in engagement with the bottom of the roller 31. The deenergization of the solenoid 33 and the operation of the microswitch 36 following the return of the plate 26 start the motor 22, driving the belts 9 and causing the pushing plate 13 to push the pile A of newspapers forward. Consequently the foremost newspaper a falls off the front end 8*a* of the support plate 8 onto the retaining plate 26, which in turn actuates the microswitch 36 to stop the motor 22 as already stated. The apparatus is now in its standby position for the delivery of the newspaper.

The newspaper falls into the outlet 3 upon depression of the push button. Thus the time needed for the transport of the newspaper on the belts is not included in the sale time. This greatly reduces the time taken for the sale of the paper without any necessity of increasing the speed of the belts while overcoming the problems that otherwise would result from the stopping of the motor and the inertial force of the newspaper. Whereas newspapers may have an increased thickness as in the case of the Sunday edition which is more than twice as thick as weekday editions, the present apparatus always assures quick delivery of newspapers despite variations in the thickness.

What is claimed is:

1. A delivery apparatus for an automatic newspaper vending machine comprising a support plate attached to the body of the machine in a position slanting downward from the front side of the machine toward the rear side thereof for delivering newspapers, a pair of belts arranged on opposite sides of the support plate for delivering newspapers, drive means including pulleys for driving the belts at a low speed in the direction of delivery of newspapers and a newspaper outlet provided on the lower front side of the machine body, further comprising:

a retaining plate operatively mounted on said body retractable from a projected position in which it projects into a path along which a newspaper pushed off the delivery end of the support plate falls, a solenoid mechanism mounted on said body and operatively associated with said retaining plate for releasably holding the retaining plate in its projected position, a spring means operatively disposed between said body and said retaining plate for urging the retaining plate into said projected position, said spring permitting the retaining plate to retract from said path under the weight of the retaining plate and the newspaper and being operable to return the retaining plate to the projected position upon the fall of the newspaper off the retaining plate, means operatively associated with said drive means for detecting said return of the retaining plate to start the drive means and for detecting the delivery of a newspaper onto the retaining plate to stope the drive means.

2. A delivery apparatus as defined in claim 1 wherein the retaining plate has a rearward extension extending toward the rear side and pivotally connected to said body by a pin, said solenoid mechanism comprising a solenoid mounted on said body to the rear of said rearward extension, a reciprocating shaft extending from the front end of said solenoid and pivotally connected to a movable arm, a roller rotatably mounted on said movable arm in a position to engage the rear end portion of said rearward extension to hold said retaining plate in said projected position and movable out of engagement with said rear end portion when said retaining plate is in the retracted position.

3. A delivery mechanism as defined in claim 2 wherein said movable arm is pivotally connected at its lower end to said body below said rear portion of said rearward extension and said roller is mounted at the upper end of said arm adapted to engage the top surface of said rear end portion when said retaining plate is in the projected position, said arm being pivotally connected to said solenoid shaft by a link member pivotally connected at one end to said shaft and at the other end to said arm at a position between said roller and said pivot connected at the lower end of said arm.

4. A delivery apparatus as defined in claim 1 wherein said means for stopping the drive means is operated by a second rearward extension from the rear side of the retaining plate.

5. A delivery apparatus as defined in claim 1 wherein the release of the retaining plate held by said solenoid mechanism and said roller on said arm is effected by a push button for purchasing a newspaper.

* * * * *